US011255331B2

(12) United States Patent
Sinico et al.

(10) Patent No.: US 11,255,331 B2
(45) Date of Patent: Feb. 22, 2022

(54) ELECTRIC PUMP ASSEMBLY WITH USER-ACCESSIBLE WET SECTION

(71) Applicant: DAB PUMPS S.P.A., Mestrino (IT)

(72) Inventors: Francesco Sinico, Montecchio Maggiore (IT); Pietro Cailotto, Trissino (IT); Enrico Trentin, Fraz. Sorio (IT); Michele Cappocchin, Mestrino (IT)

(73) Assignee: DAB PUMPS S.P.A., Mestrino (IT)

( * ) Notice: Subject to any disclaimer, the term of this patent is extended or adjusted under 35 U.S.C. 154(b) by 0 days.

(21) Appl. No.: 16/929,328

(22) Filed: Jul. 15, 2020

(65) Prior Publication Data

US 2021/0018018 A1 Jan. 21, 2021

(30) Foreign Application Priority Data

Jul. 15, 2019 (IT) ..... 102019000011709

(51) Int. Cl.

| | |
|---|---|
| ***F04D 13/06*** | (2006.01) |
| ***F04D 29/70*** | (2006.01) |
| ***F04D 29/42*** | (2006.01) |
| ***F04D 29/02*** | (2006.01) |
| ***F04D 29/62*** | (2006.01) |

(52) U.S. Cl.

CPC ..... *F04D 13/0686* (2013.01); *F04D 13/06* (2013.01); *F04D 13/064* (2013.01); *F04D 13/0606* (2013.01); *F04D 13/0626* (2013.01); *F04D 13/0693* (2013.01); *F04D 29/026* (2013.01); *F04D 29/426* (2013.01); *F04D 29/628* (2013.01); *F04D 29/708* (2013.01)

(58) Field of Classification Search

CPC .... F04D 13/0686; F04D 13/06; F04D 29/426; F04D 29/628; F04D 13/0606; F04D 13/0626; F04D 13/064; F04D 29/026; F04D 13/0693; F04D 29/708

See application file for complete search history.

(56) References Cited

U.S. PATENT DOCUMENTS 3,256,829 A * 6/1966 Schneider ..... F04D 13/0633 417/368
7,045,922 B2 * 5/2006 Marioni ..... H02K 5/128 310/91

FOREIGN PATENT DOCUMENTS

| | | |
|---|---|---|
| DE | 9207933 U1 | 9/1992 |
| DE | 4320414 A1 | 1/1995 |
| EP | 1757816 A2 | 2/2007 |
| EP | 2722599 A1 | 4/2014 |
| KR | 101888678 B1 | 8/2018 |

OTHER PUBLICATIONS

Italian Search Report dated Mar. 3, 2020 issued in IT 201900011709, with partial translation.

* cited by examiner

*Primary Examiner* — Peter J Bertheaud
(74) *Attorney, Agent, or Firm* — Scully, Scott, Murphy & Presser, P.C.

(57) ABSTRACT

A centrifugal electric pump assembly, comprising a wet section, which comprises inside it a liquid and/or solid scale remover substance in a position that at least potentially communicates with the wet section.

3 Claims, 2 Drawing Sheets

ELECTRIC PUMP ASSEMBLY WITH USER-ACCESSIBLE WET SECTION

CROSS-REFERENCE TO RELATED APPLICATIONS

This Application claims priority to Application IT 102019000011709 filed on Jul. 15, 2019.

BACKGROUND OF THE DISCLOSURE

The present invention relates to a centrifugal electric pump assembly with an electric motor.

Centrifugal electric pump assemblies are currently known which are substantially composed of a hollow body provided with an intake duct and a delivery duct and containing one or more impellers interleaved by diffusers and keyed on the shaft of an electric motor which is integral with the rotor of said electric motor, which is enclosed within a motor casing that isolates it from the pumping liquid.

In the case of centrifugal electric pump assemblies with a single impeller the presence of diffusers is not necessary.

The shaft is generally supported by two or more bushings.

These known methods have some drawbacks and aspects that can be improved.

These centrifugal electric pump assemblies are normally used in the heating systems of buildings.

These electric pumps usually have a single impeller and are also known as circulating pumps.

Maintenance in heating systems is normally performed during the spring/summer period, in which it is not necessary to turn on the heating.

During the maintenance of a system:

- the electric pump assembly that is present may be replaced with a new one,
- the electric pump assembly may be removed temporarily from the system,
- the system may be drained of the circulating water and then filled again.

In these conditions, air enters the system and the electric pump assembly.

After maintenance, the system generally remains inactive even for a few months before it is restarted.

Scale can form during this period of time.

The forming of scale in the mechanical parts of the pump generates deposits that are capable of causing the jamming of the rotating part of the pump.

BRIEF SUMMARY OF THE DISCLOSURE

The aim of the present invention is to provide an electric pump assembly that is capable of improving the background art in one or more of the aspects indicated above.

Within this aim, an object of the invention is to provide an electric pump assembly in which scale is not generated.

Another object of the invention is to provide an electric pump assembly in which deposits are not generated between the moving parts and the fixed ones and jamming of the shaft does not occur even following maintenance and lack of use of the electric pump for a long period.

Another object of the invention is to provide an electric pump assembly that is highly reliable, relatively easy to provide and at competitive costs.

This aim, these objects and others which will become better apparently hereinafter are achieved by a centrifugal electric pump assembly, comprising a wet section, characterized in that it comprises inside it a liquid and/or solid scale remover substance in a position that at least potentially communicates with said wet section.

BRIEF DESCRIPTION OF THE SEVERAL VIEWS OF THE DRAWINGS

Further characteristics and advantages of the invention will become better apparent from the description of some preferred but not exclusive embodiments of the centrifugal electric pump assembly according to the invention, illustrated by way of non limiting example in the accompanying drawings, wherein.

DETAILED DESCRIPTION OF THE DISCLOSURE

Figure 1:
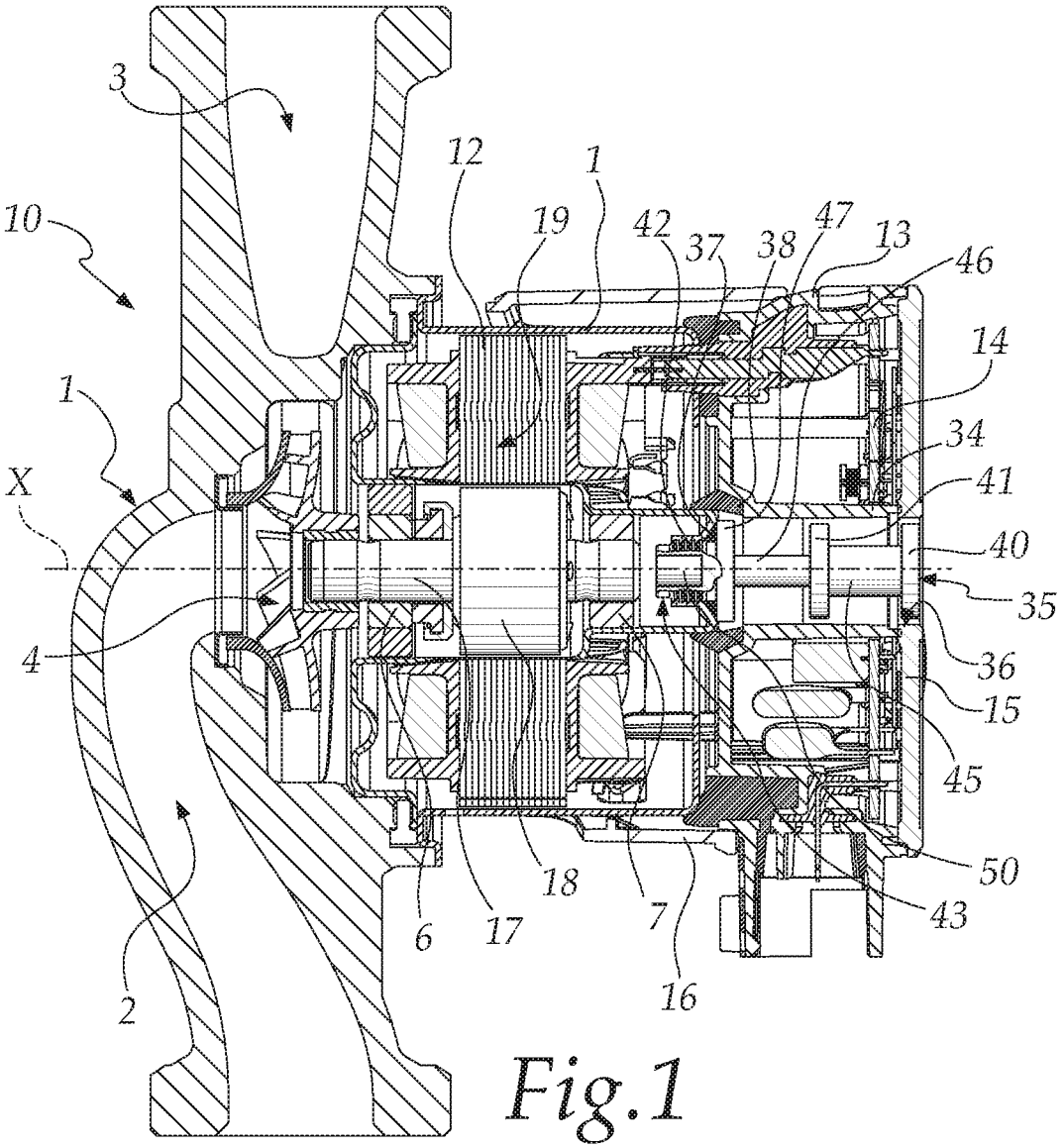
FIG. 1 is a sectional view of a centrifugal electric pump assembly according to the invention in a first embodiment.

With reference to the figures, a centrifugal electric pump assembly according to the invention is designated generally by the reference numeral 10.

The centrifugal electric pump assembly 10 comprises a wet section 1 provided with an intake duct 2 and a delivery duct 3 of a known type, and an impeller 4 immersed in the wet section 1.

The impeller 4 is keyed on a shaft 17 of an electric motor 19 which is composed of a stator 12 and a rotor 18.

The rotor 18 is comprised between two supporting bushings 6 and 7 of the shaft 17;

- a first bushing 6, located proximate to the impeller 4,
- a second bushing 7, which is opposite the first bushing 6 and is located at the end of the shaft 17 that is opposite the one provided with the impeller 4.

The electric motor 19 is arranged in a stator receptacle 11 which is adapted to isolate it from the wet section 1.

The centrifugal electric pump assembly 10 comprises, at one end, an electrical box 13, which contains an electrical board 14 that is adapted to control and supply power to the electric motor 19.

The electrical box 13 has a cylindrical extension and is closed at the free end by a lid 15.

Advantageously, the electrical box 13 may also have a different extension.

The electric motor 19 and the electrical box 13 are extended along a same axis X, which coincides with the rotation axis of the rotor 18 and of the impeller 4.

The electric motor 19 and the electrical box 13 are connected and rendered integral by the presence of an intermediate element 16.

The intermediate element 16 is a connecting and/or covering element and has a tubular shape.

The electrical box 13 is provided internally with a tubular body 34 with an axis of extension that coincides with the axis X.

The tubular body 34 extends from the surface of contact with the stator receptacle 11 to the lid 15 of the electrical box 13.

At the section of the tubular body 34, both the electrical board 14 and the lid 15 are provided with a through hole 36 with an axis of extension that coincides with the axis X.

Advantageously, the axis of extension of the hole may not coincide with the axis X but may be parallel thereto.

The through hole 36 and the tubular body 34 are adapted for the insertion of a plug 35 with a first end in contact with the wet section 1.

The tubular body 34 and the hole 36 of the lid 15 have such dimensions and shapes as to ensure interference and isolation of the electrical board 14 from the wet section 1 even if the plug 35 is open.

The plug 35 has:

at a first end, a contour 43 that is adapted to enter a hole which communicates with the wet section 1, acting as a flow control element, with said hole that communicates with the wet section 1 proximate to the second bushing 7, at the other end, a head 40 that is adapted to be easily accessible to the user.

The plug 35 has a cylindrical extension and such a length that the external surface of the head 40 is at a level that is proximate to the level of the lid 15 of the box 13 in the closed configuration.

The contour 43 comprises a disk-like end element 47 which continues in the hole that communicates with the wet section 1 with a threaded element 42 that is adapted to define the locking of the plug 35 in the complementarily threaded hole in a complementary manner.

The disk-like element 47 has dimensions that are equal to or in any case comparable with those of the head 40.

The head 40 is disk-like and has a notch, not shown in the figures, adapted for the insertion of the tip of a screwdriver to allow the unscrewing and screwing operation.

The plug 35 has an intermediate section 41 which is also disk-like and has dimensions that are similar to those of the head 40 in order to facilitate the insertion of the plug in the hole 36 and in the tubular body 34.

A first tubular section 45 is interposed between the head 40 and the intermediate element 41 and has a smaller diameter than the head 40.

A second tubular section 46 is interposed between the intermediate element 41 and the end element 47 and has a smaller diameter than the first tubular section 45.

The presence of these cylindrical sections with reduced diameter allows to avoid thermal bridges and allows to obtain a lighter plug for an equal cost.

The plug 35 is made of brass by a turning operation and all its parts are obtained from a single piece.

Advantageously, the plug 35 may be made of stainless steel.

The seal between the wet section and the plug 35 is ensured by an O-ring 37 of the known type and the seal between the wet section, the electrical box 13 and the stator receptacle 11 is ensured by a gasket 38 of the known type.

One of the particularities of the invention is the presence, inside the electric pump assembly 10, of a scale remover substance, which is adapted to prevent the forming of scale.

The scale remover substance, which can be in solid form and in liquid form, is constituted for example by polyphosphates.

In particular, said scale remover substance is in a position that at least potentially communicates with the wet section.

The scale remover substance is located proximate to and/or at the plays between the moving parts and the fixed parts of the electric pump.

Advantageously, the scale remover substance is present between the stator receptacle 11 and the shaft 17.

For example, the scale remover substance is sprayed on the shaft 17 or on the internal profile of the bushings 6, 7.

Preferably, the scale remover substance is located proximate to the second bushing 7.

In a first embodiment, shown in FIG. 1, the scale remover substance is constituted by a tablet 50 of polyphosphates which is inserted in an adapted seat in the first end of the plug 35, within the contour 43.

The tablet 50 avoids the forming of scale inside the electric pump assembly 10, at the same time avoiding deposits between the moving parts and the fixed parts of the electric pump even after the introduction of air and after non-use of the electric pump for a long period.

The polyphosphates contained in the tablet in fact have chelating characteristics with respect to the atoms of the salts contained in water (in particular calcium and magnesium salts), preventing their precipitation and the consequent forming of scale even following a reaction between air and water.

In the present description, the expression "chelating characteristics" is understood to mean that the molecules of the scale remover substance have two groups that are capable of bonding, like two claws, to a same metallic atom by means of secondary or primary valences, forming stable soluble compounds which do not precipitate.

Figure 2:
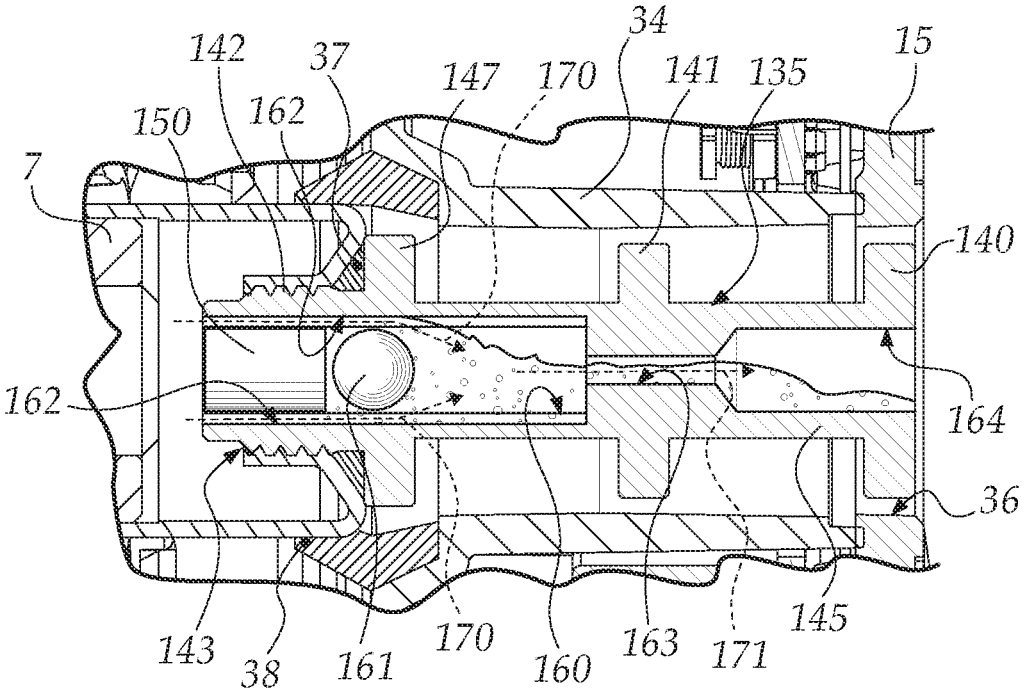
FIG. 2 is a sectional view of a detail of a centrifugal electric pump assembly according to the invention in a second embodiment.

FIG. 2 partially shows a second embodiment. In this second embodiment, the electric pump assembly is similar to the one of the preceding case except for the plug 135.

The plug 135 has, in a manner similar to the preceding embodiment:

at a first end, a contour 143 adapted to enter a hole which communicates with the wet section, not shown in the figures, but is similar to that of the preceding embodiment, acting as a flow control element, with said hole that communicates with the wet section proximate to the second bushing 7, at the other end, a head 140 adapted to be easily accessible to the user.

The plug 135 has a cylindrical extension and such a length that the external surface of the head 140 is at a level that is close to that of the lid 15 of the electrical box, not shown in the figure, in the closed configuration.

The contour 143 comprises a disk-like end element 147 which continues in the hole, which communicates with the wet section, with a threaded hole 142 adapted to define the locking of the plug 135 in the complementarily threaded hole in a complementary manner.

The disk-like element 147 has dimensions which are equal to or in in any case comparable with those of the head 140.

The head 140 is disk-like and has a notch, not shown in the figures, adapted for the insertion of the tip of a screwdriver in order to allow the unscrewing and screwing operation.

The plug 135 has an intermediate section 141 which also is disk-like and has dimensions similar to those of the head 140 in order to facilitate the insertion of the plug in the hole 36 and in the tubular body 34.

A first tubular section 145 is interposed between the head 140 and the intermediate element 141 and has a smaller diameter than the head 140.

A second tubular section 146 is interposed between the intermediate element 141 and the end element 147 and has a diameter that is smaller than and/or equal to that of the first tubular section 145.

The presence of these cylindrical sections with reduced diameter allows to avoid thermal bridges and allows to obtain a lighter plug at an equal cost.

The plug 135 is made of brass by a turning operation and all its parts are obtained from a single piece.

Advantageously, the plug 135 can be made of stainless steel.

The seal between the wet section and the plug 135 is ensured by an O-ring 37 of the known type; the seal between the wet section, the electrical box 13 and the stator receptacle 11 is ensured by a gasket 38 of the known type.

In this case also, the scale remover substance is constituted by a tablet 150 of polyphosphates which is inserted in an adapted seat in the first end of the plug 135 within the contour 143.

In this second embodiment, inside the plug 135 there is a tubular seat 160 with a longitudinal extension between the first end with the contour 143 and the intermediate element 141.

At the first end of the plug 135, inside the seat 160, there is the tablet 150.

A ball valve 161 is movable inside said seat 160 from a first active position, in contact with the tablet 150, to a second inactive position, at the end of the seat 160 proximate to the intermediate element 141 and at the inlet of a duct 163.

One or more grooves 162 having a longitudinal and/or helical extension are present on the surface of the wall of the seat 160.

The seat 160 leads into a duct 163 that has a smaller cross-section and is arranged substantially at the intermediate element 141, which in turn leads into a through hole 164 which passes through the head 140 of the plug 135.

The duct 163 has a cross-section that is smaller than that of the seat 160 and than that of the ball valve 161.

The plug 135 avoids the forming of scale and allows the automatic venting of any air that is present within the electric pump assembly 10.

Its operation is as follows.

The air that is present inside the electric pump moves together with the water and interacts with the plug 135, which is in contact with the wet section 1.

The air and water pass through the grooves 162, partly flowing around the ball valve 161 along the direction of the arrows 170.

The air does not move the valve 161, but the water does.

The air is propelled by the water and exits from the electric pump by passing through the seat 160, the duct 163 (arrow 171) and the hole 164.

As the electric pump assembly vents and the air exits, the water moves the valve 161 from the first position to the second position.

When the valve reaches the second position, all the air has exited and due to the dimensions of the ball with respect to the cross-section of the duct 163 an obstruction is generated which prevents further outflow of water.

In this matter there is no longer any air inside the electric pump assembly 10 and in the system, and scale cannot form.

In practice it has been found that the invention achieves the intended aim and objects, providing an electric pump assembly in which scale does not form.

The invention provides an electric pump assembly in which deposits are not generated between the moving parts and the fixed ones and jamming of the shaft does not occur even following maintenance and non-use of the electric pump for a long period.

The invention thus conceived is susceptible of numerous modifications and variations, all of which are within the scope of the appended claims; all the details may furthermore be replaced with other technically equivalent elements.

In practice, the materials used, so long as they are compatible with the specific use, as well as the contingent shapes and dimensions, may be any according to the requirements and the state of the art.

The disclosures in Italian Patent Application No. 102019000011709 from which this application claims priority are incorporated herein by reference.

What is claimed is:

1. A centrifugal electric pump assembly comprising:

an electric motor, an electrical box, at one end of the electric motor, that contains an electrical board adapted to control and supply power to said electric motor, said electrical box being closed at a free end by a lid, a wet section provided with an intake duct and a delivery duct, an impeller, said impeller being keyed on a shaft of said electric motor, said electric motor being composed of a stator and a rotor, said rotor being integral with said shaft, said stator being contained in a receptacle, said rotor being comprised between two bushings:

a first bushing, arranged proximate to said impeller, a second bushing, arranged opposite said first bushing and located at the end of said shaft that is opposite to the one provided with said impeller, a scale remover substance proximate to said second bushing, and a plug, provided with:

at a first end, a contour that is adapted to enter a hole which communicates with said wet section, acting as a flow control element, said hole that communicates with said wet section being proximate to said second bushing, at another end, a head adapted to be easily accessible to a user, said scale remover substance being constituted by a tablet which is inserted in a seat in said first end of said plug.

2. The electric pump assembly according to claim 1, wherein in said plug there is a longitudinally extended tubular seat starting from said first end with said contour, at said first end of said plug, inside said seat, there being said tablet, a valve being movable within said seat from a first active position to a second inactive position, said second position being located at the inlet of a duct, on the surface of the wall of said seat there being one or more longitudinally and/or helically extended grooves, said seat leading into said duct, said duct in turn leading into a through hole, said through hole passing through said head of said plug, said duct having a cross-section that is smaller than that of said seat and that of said valve.

3. The electric pump assembly according to claim 2, wherein said valve is a ball valve, and wherein said first active position is in contact with said tablet, and said second inactive position is at the opposite end of said seat.

* * * * *